US011466391B2

(12) United States Patent
Im et al.

(10) Patent No.: US 11,466,391 B2
(45) Date of Patent: Oct. 11, 2022

(54) METHOD FOR CONTROLLING WASHING MACHINE

(71) Applicant: LG Electronics Inc., Seoul (KR)

(72) Inventors: Myunghun Im, Seoul (KR); Hwanjin Jung, Seoul (KR); Kyungchul Woo, Seoul (KR); Hyundong Kim, Seoul (KR); Junghoon Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 185 days.

(21) Appl. No.: 16/617,339

(22) PCT Filed: May 10, 2018

(86) PCT No.: PCT/KR2018/005348
§ 371 (c)(1),
(2) Date: Nov. 26, 2019

(87) PCT Pub. No.: WO2018/208088
PCT Pub. Date: Nov. 15, 2018

(65) Prior Publication Data

US 2021/0277560 A1 Sep. 9, 2021

(30) Foreign Application Priority Data

May 10, 2017 (KR) ..... 10-2017-0058277

(51) Int. Cl.
*D06F 39/02* (2006.01)
*D06F 39/08* (2006.01)
(Continued)

(52) U.S. Cl.
CPC ..... *D06F 39/02* (2013.01); *D06F 33/34* (2020.02); *D06F 34/06* (2020.02); *D06F 39/022* (2013.01);
(Continued)

(58) Field of Classification Search
CPC ..... D06F 33/38; D06F 33/40
See application file for complete search history.

(56) References Cited

U.S. PATENT DOCUMENTS 5,191,668 A * 3/1993 Euler ..... D06F 35/006 8/158
2009/0249840 A1* 10/2009 Jo ..... D06F 39/083 68/5 C
(Continued)

FOREIGN PATENT DOCUMENTS

JP 2012130813 7/2012
JP 2013052127 3/2013
(Continued)

OTHER PUBLICATIONS

KR Office Action in Korean Appln. No. 10-2017-0058277, dated Jan. 28, 2021, 13 pages (with English translation).
(Continued)

*Primary Examiner* — Spencer E. Bell
(74) *Attorney, Agent, or Firm* — Fish & Richardson P.C.

(57) ABSTRACT

A method of controlling a washing machine of the present invention includes the steps of: (a) supplying detergent contained in a dispenser together with water into an inner tub; (b) operating a pump to transfer the water supplied together with the detergent to a plurality of nozzles disposed above the inner tub; and (c) further supplying water into the inner tub, operating the pump while the water is being supplied, and rotating the inner tub so that laundry contained in the inner tub adheres to an inner surface of the inner tub by centrifugal force during the operation of the pump.

16 Claims, 21 Drawing Sheets

(51) Int. Cl.

| | |
|---|---|
| ***D06F 33/34*** | (2020.01) |
| ***D06F 105/48*** | (2020.01) |
| ***D06F 105/42*** | (2020.01) |
| ***D06F 103/18*** | (2020.01) |
| ***D06F 103/24*** | (2020.01) |
| ***D06F 34/06*** | (2020.01) |

(52) U.S. Cl.

CPC ..... *D06F 39/08* (2013.01); *D06F 39/085* (2013.01); *D06F 2103/18* (2020.02); *D06F 2103/24* (2020.02); *D06F 2105/42* (2020.02); *D06F 2105/48* (2020.02)

(56) References Cited

U.S. PATENT DOCUMENTS

| | | | | |
|---|---|---|---|---|
| 2013/0081431 | A1* | 4/2013 | Hill | D06F 35/006 68/12.05 |
| 2019/0069752 | A1* | 3/2019 | Persson | D06F 33/36 |

FOREIGN PATENT DOCUMENTS

| | | |
|---|---|---|
| JP | 2016198173 | 12/2016 |
| KR | 1020020045385 | 6/2002 |
| KR | 20100060907 | 6/2010 |
| KR | 1020130091101 | 8/2013 |
| KR | 1020160044901 | 4/2016 |
| KR | 101708665 | 2/2017 |

OTHER PUBLICATIONS

PCT International Search Report in International Appln. No. PCT/KR2018/005348, dated Sep. 13, 2018, 8 pages (with English translation).

Office Action in Korean Appln. No. 10-2017-0058277, dated Jul. 28, 2021, 11 pages (with English translation).

* cited by examiner

METHOD FOR CONTROLLING WASHING MACHINE

CROSS-REFERENCE TO RELATED APPLICATIONS

This application is a National Stage application under 35 U.S.C. § 371 of International Application No. PCT/KR2018/005348, filed on May 10, 2018, which claims the benefit of Korean Application No. 10-2017-0058277, filed on May 10, 2017. The disclosures of the prior applications are incorporated by reference in their entirety.

TECHNICAL FIELD

The present invention relates to a control method of a washing machine.

Background Art

In general, a washing machine is provided with an outer tub in a casing and an inner tub which accommodates laundry (or "cloth") and is rotatably provided in the outer tub, and further includes a dispenser for supplying water into the inner tub (or outer tub). The dispenser includes a drawer containing detergent, and water supplied to the dispenser is supplied into the inner tub together with the detergent while passing through the drawer.

After the water is supplied together with the detergent, a pulsator and/or the inner tub rotatably provided in the inner tub is rotated, so that the contaminations of the laundry is removed by emulsification of the detergent, the water flow action generated by the rotation of the inner tub or the pulsator, and the physical impact applied from the pulsator.

However, the conventional washing machine has a narrow range in which detergent water is discharged through the dispenser, so that the range in which the water supplied through the dispenser directly touches the laundry is also limited. Therefore, it can be seen that the laundry is sufficiently wetted only when the water level in the inner tub is sufficiently raised to the extent that the laundry is submerged as the water is continuously supplied through the dispenser. However, even in this case, typically, all of the detergent is discharged from the drawer at the beginning of the water supply, and then, only water is supplied without supply of detergent. Therefore, even if the water supply is completed and all the laundry in the inner tub is submerged, there is a problem in that detergent does not penetrate smoothly to the laundry positioned in the upper side among the loaded laundry.

For this reason, the conventional washing machine, after completion of water supply, performs a cloth soaking process in which the inner tub and/or the pulsator are rotated according to a preset algorithm, as a method for evenly applying the detergent water to the laundry. However, there is a problem in that the overall washing time becomes long.

In addition, recently, in some cases, a circulation system for circulating water discharged from the outer tub through a circulation pipe and supplying the water again to the inner tub is applied. However, even in this case, as the circulation pipe is connected to a single nozzle, there is a limit on evenly washing the laundry.

Disclosure

Technical Problem

A first object of the present invention is to provide a control method of a washing machine for evenly applying detergent to a laundry loaded in an inner tub, and in particular, to provide a control method of a washing machine for sufficiently applying detergent to the upper ones among the laundry loaded in the inner tub.

A second object of the present invention is to provide a control method of the washing machine that can quickly apply detergent to the laundry loaded in the inner tub.

A third object of the present invention is to provide a control method of the washing machine that can shorten the overall time required for washing, by shortening or excluding a process required for cloth soaking that applies the detergent to the laundry.

Technical Solution

A method of controlling a washing machine of the present invention supplies detergent contained in a dispenser together with water into an inner tub, operates a pump to transfer the water supplied together with the detergent to a plurality of nozzles disposed above the inner tub, further supplies water into the inner tub, and operates the pump.

The pump may operate while the water is being supplied, and the inner tub may rotate so that laundry contained in the inner tub adheres to an inner surface of the inner tub by centrifugal force during the operation of the pump.

The step of supplying detergent contained in a dispenser together with water into an inner tub may include: opening a water supply valve for supplying water to the dispenser; and blocking the water supply valve, when a water level in an outer tub in which the inner tub is accommodated reaches a preset first water level.

The step of further supplying water into the inner tub may include opening the water supply valve; and blocking the water supply valve, when the water level in the outer tub reaches a preset second water level.

When the pump is operated in a state in which water is further supplied into the inner tub, the pump can be rotated at a higher speed than the previous case where the pump is operated to transfer the water supplied together with the detergent to a plurality of nozzles disposed above the inner tub.

A method of controlling a washing machine of the present invention includes a water supply step of supplying detergent contained in a dispenser together with water into an inner tub, a first soaking step of operating a pump to transfer the water supplied together with the detergent to a plurality of nozzles disposed above the inner tub, and a second soaking step of further supplying water into the inner tub through the dispenser, and operating the pump while water is being supplied. In the second soaking step, the pump may rotate.

In the second soaking step, the pump may rotate at a higher speed than in the first soaking step. The second soaking step further includes rotating the inner tub so that laundry contained in the inner tub adheres to an inner surface of the inner tub by centrifugal force during the operation of the pump.

The water supply step may include opening a water supply valve for supplying water to the dispenser, and blocking the water supply valve, when a water level in an outer tub in which the inner tub is accommodated reaches a preset first water level.

The step (b) may further include stopping the operation of the pump, and the step (c) may include operating the pump again, after the operation of the pump is stopped in the step (b) and a preset time is elapsed. The water supply step may further include stopping water supply when the water level in the outer tub reaches a preset second water level. The method may further include washing laundry by controlling rotation of at least one of the inner tub and a pulsator rotatably provided in the inner tub, after the second soaking step.

Advantageous Effects

The control method of the washing machine according to the present invention has an effect of uniformly washing laundry by applying detergent evenly to the laundry loaded in the inner tub. In particular, by sufficiently applying detergent to the upper ones among the laundry loaded in the inner tub, there is an effect that it is possible to evenly wash both the laundry positioned in the lower portion of the inner tub and the laundry positioned in the upper portion of the inner tub.

Second, the process required for cloth soaking is shortened or excluded by quickly applying detergent to the laundry loaded in the inner tub, so that there is an effect of reducing the overall time required for washing, and reducing the power consumption.

Third, by spraying circulating water (water in which detergent is dissolved) in various directions into the inner tub through a plurality of nozzles, there is an effect of widening the spray range of the circulating water.

MODE FOR INVENTION

Figure 1:
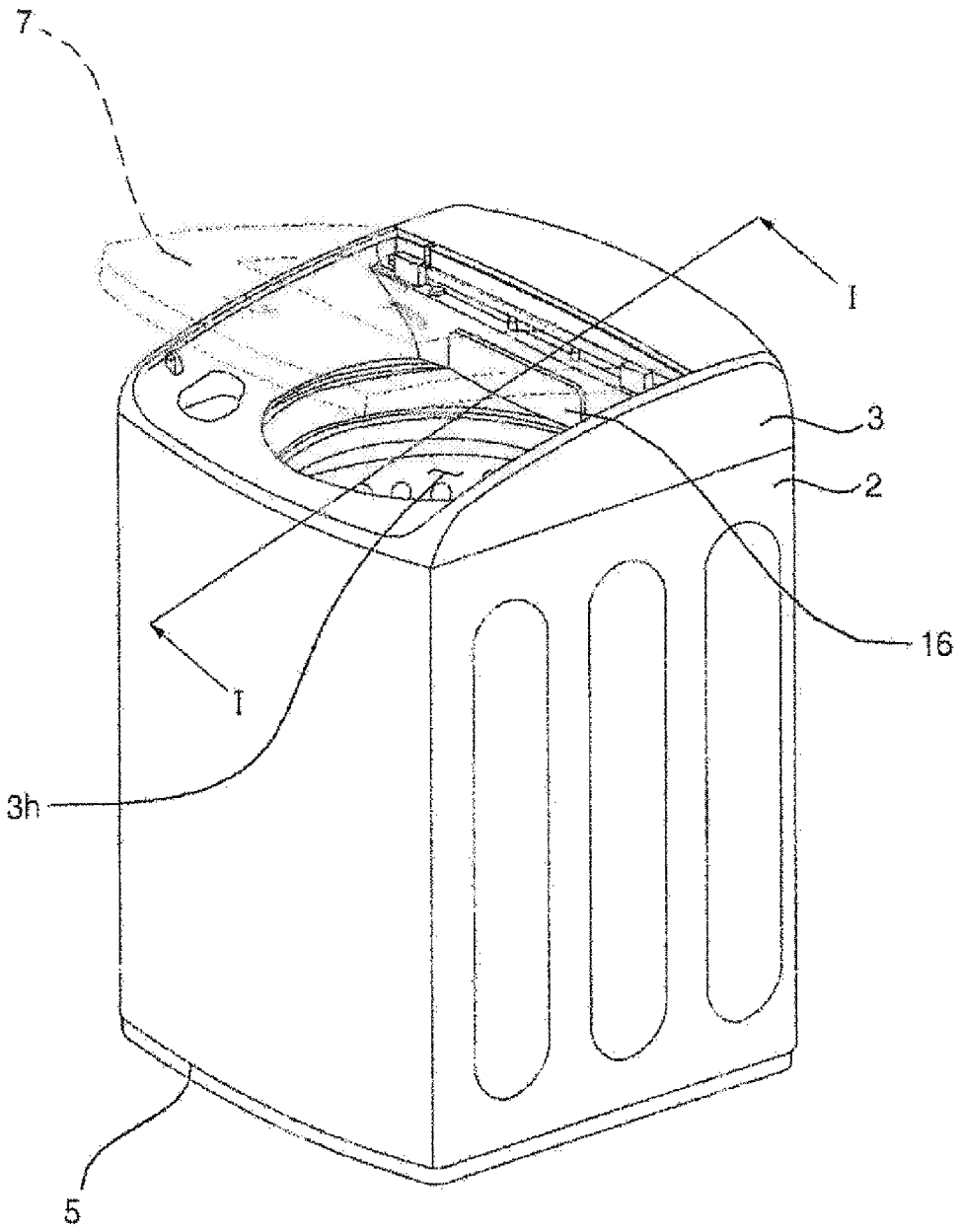
FIG. 1 is a perspective view of a washing machine according to an embodiment of the present invention.
Figure 2:
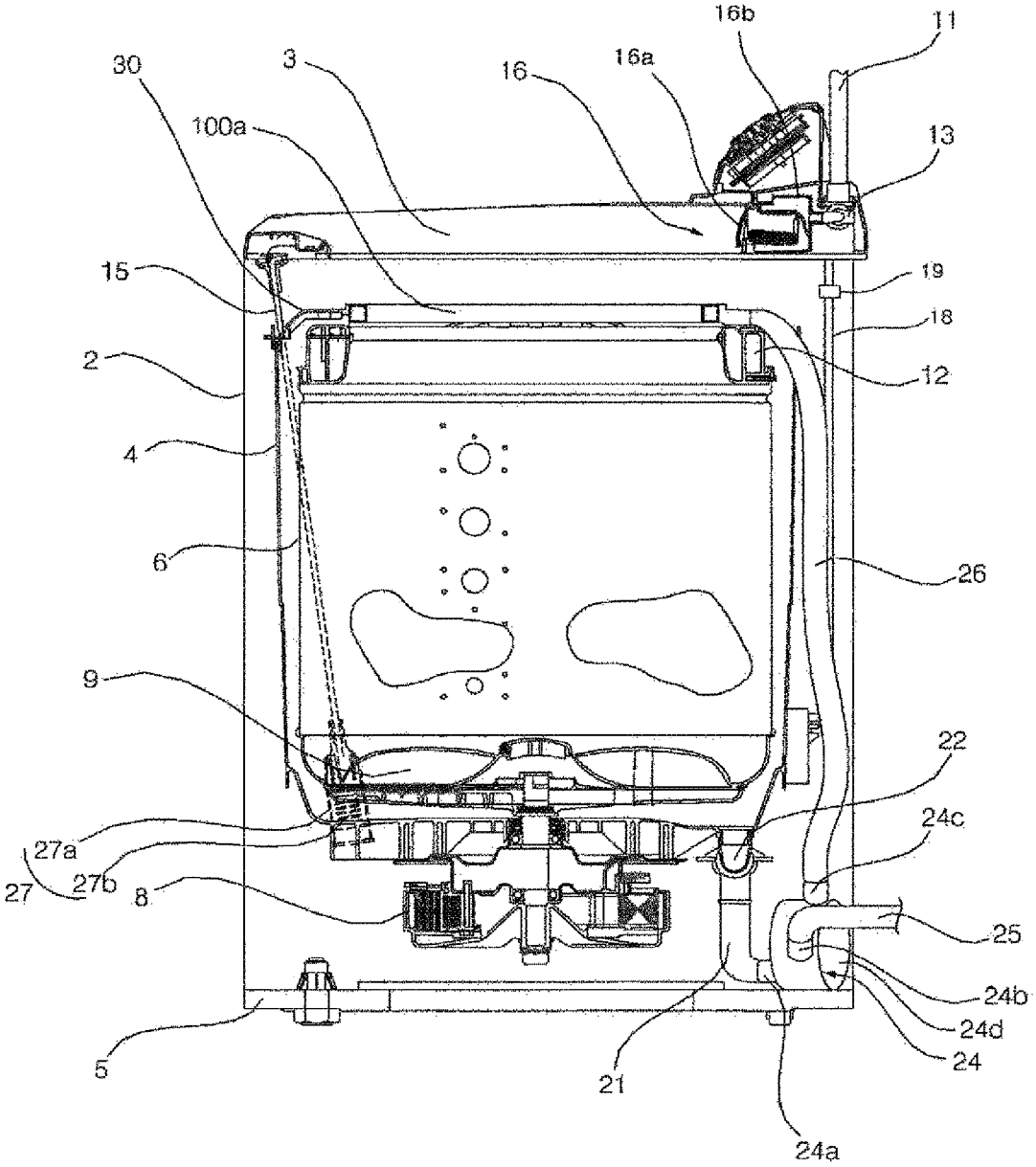
FIG. 2 is a cross-sectional side view taken along the line I-I of FIG. 1.
Figure 3:
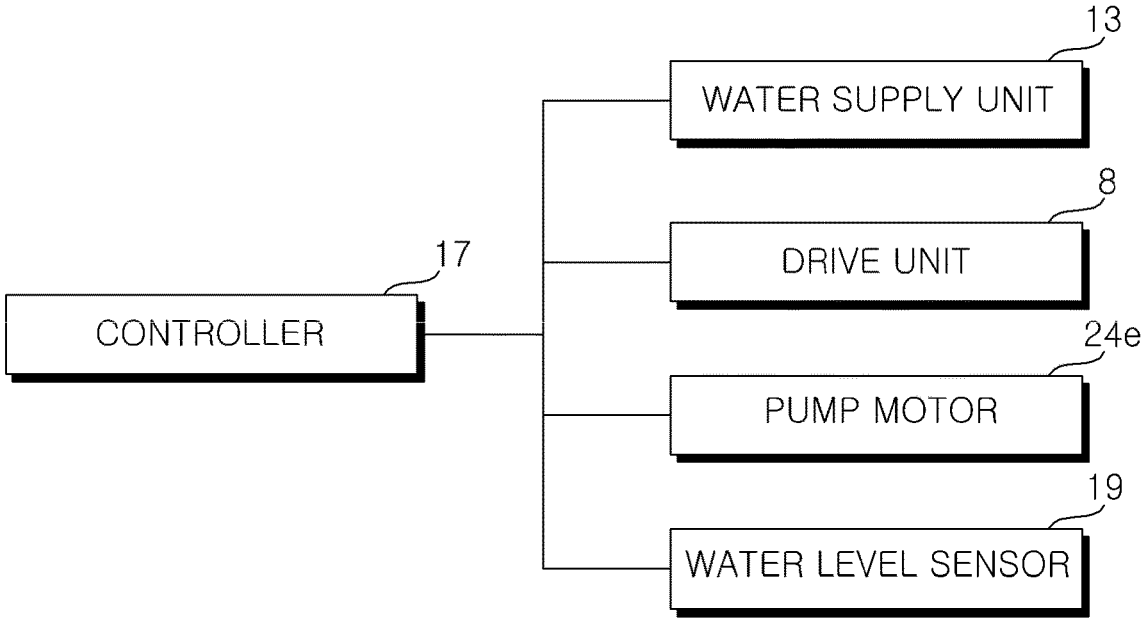
FIG. 3 is a block diagram showing a control relationship between major components of a washing machine according to an embodiment of the present invention.
Figure 4:
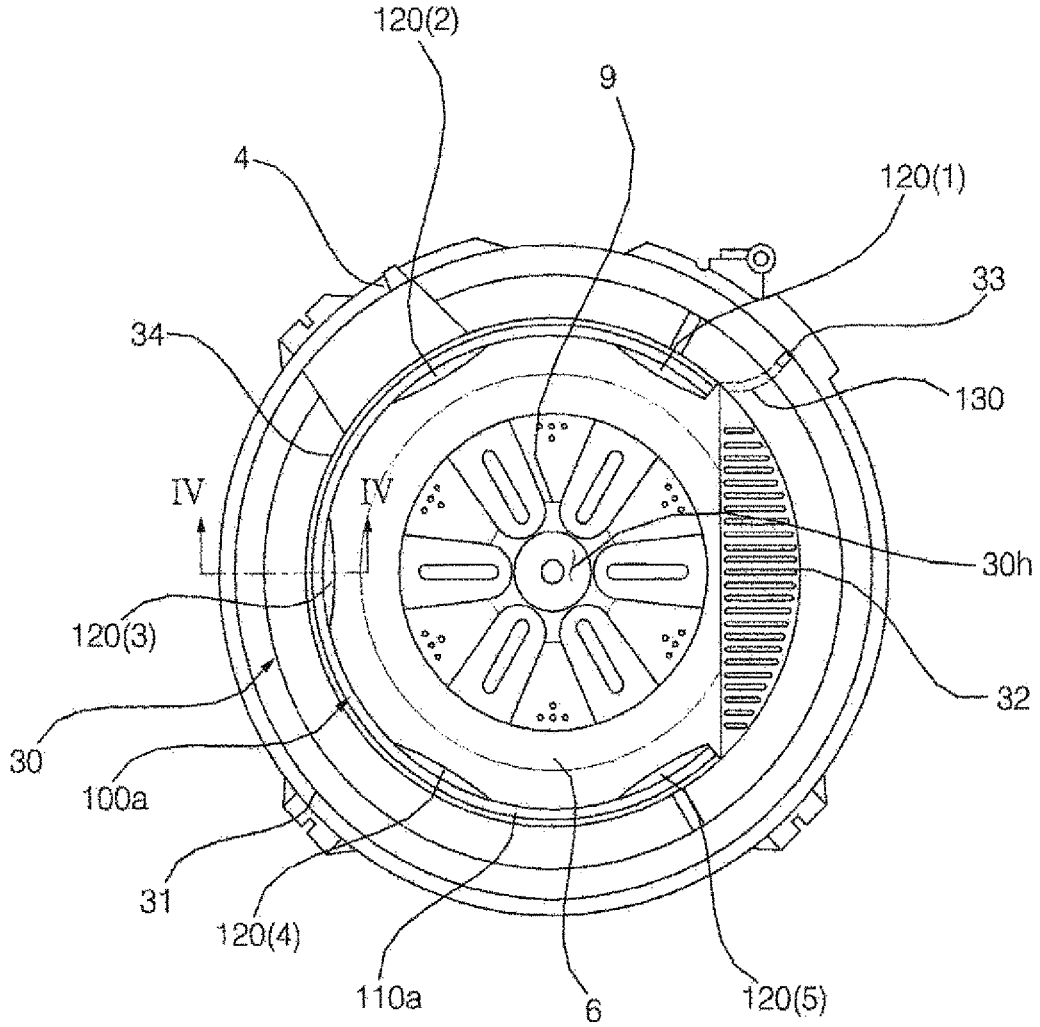
FIG. 4 is a partial view of a washing machine according to an embodiment of the present invention.
Figure 5:
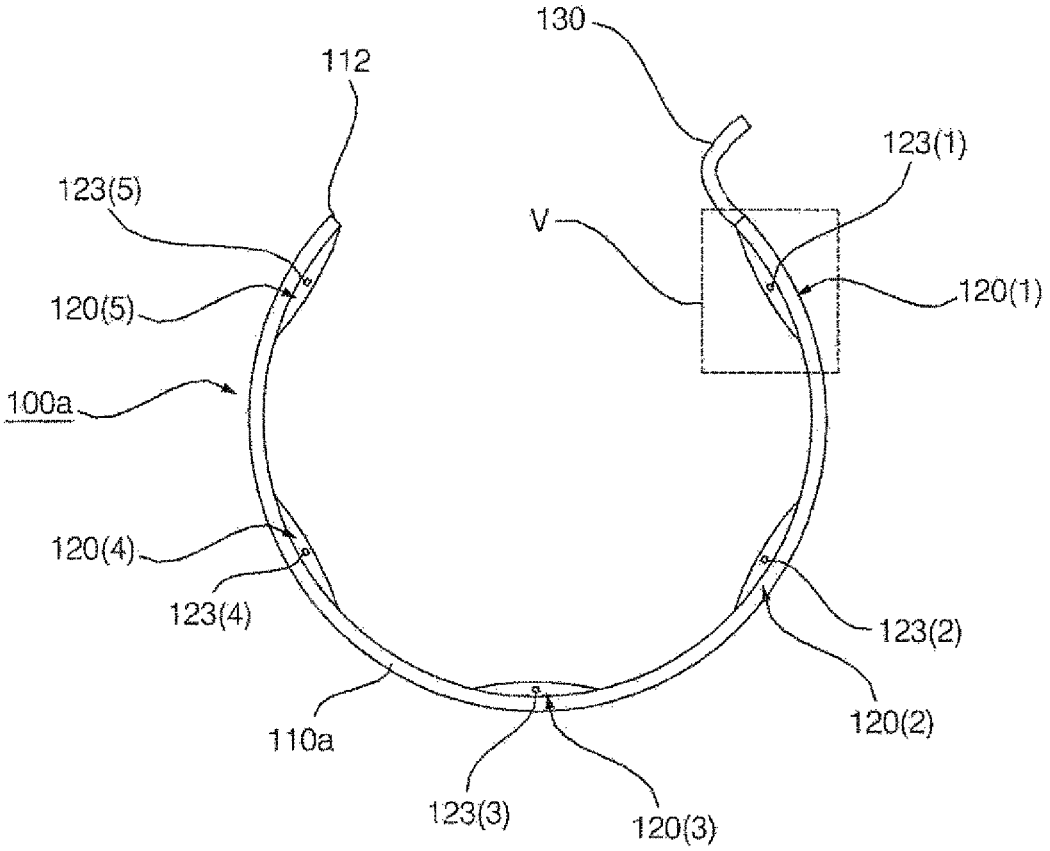
FIG. 5 shows a spray mechanism shown in FIG. 4.
Figure 6:
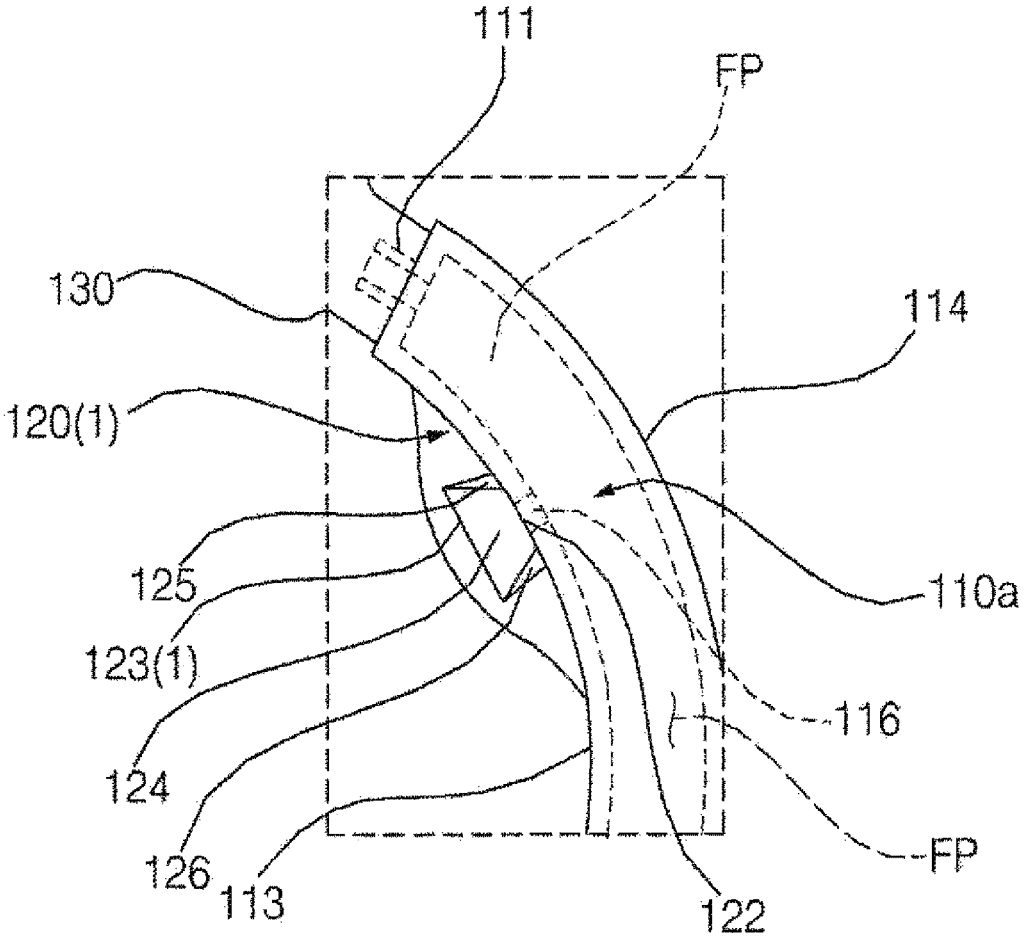
FIG. 6 shows a portion V of FIG. 5.
Figure 7:
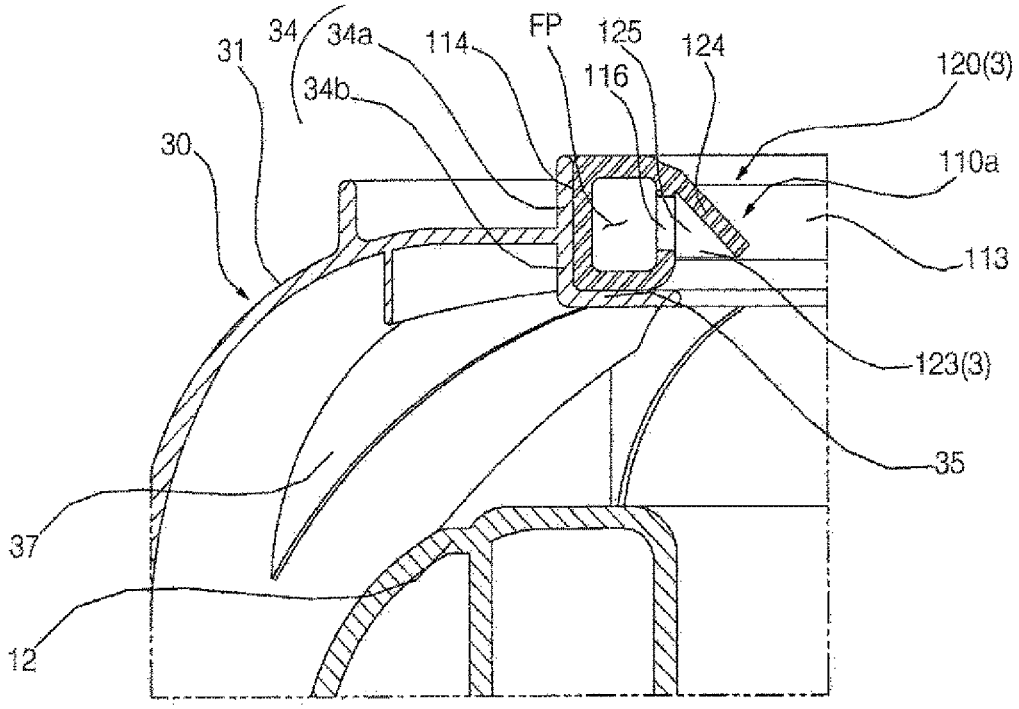
FIG. 7 shows a cross-sectional view taken along the line IV-IV of FIG. 4.
Figure 8:
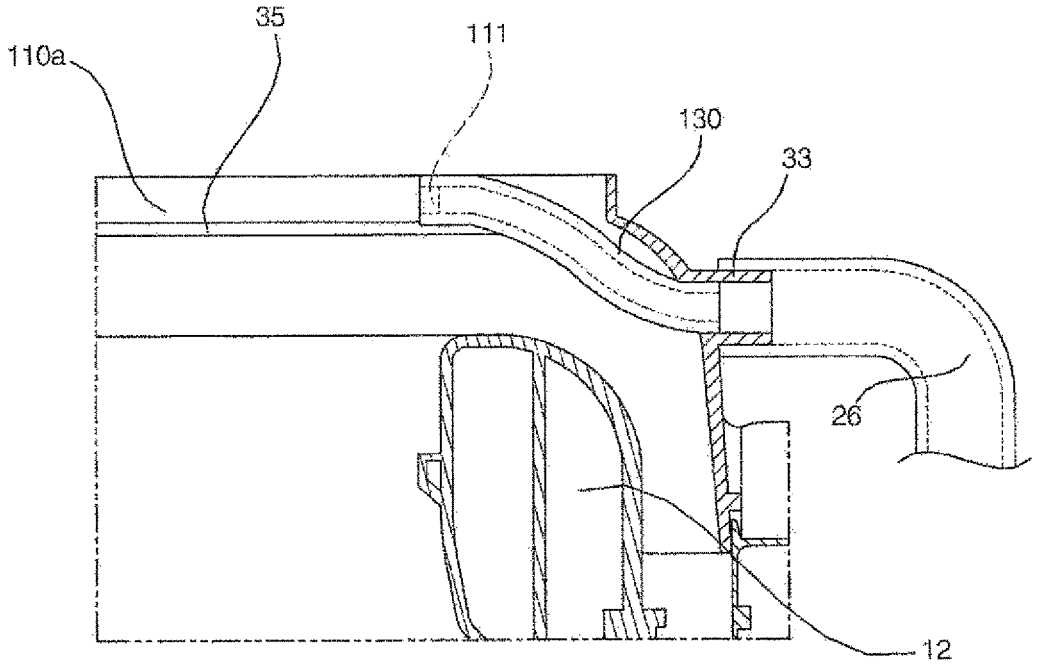
FIG. 8 shows an embodiment of a structure in which a spray mechanism and a circulation pipe are connected.

FIG. 1 is a perspective view of a washing machine according to an embodiment of the present invention. FIG. 2 is a cross-sectional side view taken along the line I-I of FIG. 1. FIG. 3 is a block diagram showing a control relationship between major components of a washing machine according to an embodiment of the present invention. FIG. 4 is a partial view of a washing machine according to an embodiment of the present invention. FIG. 5 shows a spray mechanism shown in FIG. 4. FIG. 6 shows a portion V of FIG. 5. FIG. 7 shows a cross-sectional view taken along the line IV-IV of FIG. 4. FIG. 8 shows an embodiment of a structure in which a spray mechanism and a circulation pipe are connected.

Referring to FIGS. 1 and 2, a cabinet 2 forms an outer shape of a washing machine and forms a space in which an outer tub 4 is accommodated. The cabinet 2 is supported by a flat base 5, and may include a top surface that is open, a front side, a left side, a right side, and a rear side.

A top cover 3 may be coupled to an open upper end of the cabinet 2. The top cover 3 may be provided with a loading port 3*h* for loading and unloading laundry (or "cloth"). A door 7 for opening and closing the loading port 3*h* may be rotatably coupled to the top cover 3.

The outer tub 4 is implemented to contain washing water, and may be suspended in the cabinet 2 by a support rod 15. The support rod 15 may be provided in four corners of the cabinet 2 respectively, one end of each support rod 15 pivotally connected to the top cover 3, and the other end thereof is connected to the outer tub 4 by a suspension 27.

Specifically, in the state of being fitted to the support rod 15, the suspension 27 may include a suspension cap 27*a* which is provided to be movable along the support rod 15 and a spring 27*b* which is fixed to the other end of the support rod 15 and elastically support the suspension cap 27*a*. The outer tub 4 is supported by the suspension cap 27*a*. Thus, when vibration of the outer tub 4 occurs, the suspension cap 27*a* together with the outer tub 4 is moved along the support rod 15, and the spring 27*b* is also deformed due to the displacement of the cap 27*a*.

The outer tub 4 may have an opened upper surface, and an outer tub cover 30 may be provided on the opened upper surface. The outer tub cover 30 is formed in a ring shape having an approximately circular opening 30*h* (see FIG. 4) formed in a center portion thereof, and laundry is loaded into an inner tub 6 through the opening 30*h*. The outer tub cover 30 may be made of a synthetic resin material.

In the outer tub 4, the inner tub 6 which accommodates laundry and is rotated about a vertical axis may be accommodated. The inner tub 6 may be provided with a plurality of through holes through which water passes, and water may be exchanged between the inner tub 6 and the outer tub 4 through the through hole.

In the upper end of the inner tub 6, a balancer 12 for correcting the eccentricity caused when the inner tub 6 is rotated may be provided. The balancer 12 is provided with a fluid or a mass (or a rigid body) in an annular space provided along the upper end of the inner tub 6. When the inner tub 6 is biased to one side, the fluid or mass is moved to the opposite side so that eccentricity is automatically corrected.

A drain bellows 21 for discharging water from the outer tub 4 and a drain valve 22 for controlling the drain bellows 21 may be provided. The drain bellows 21 may be connected to the pump 24. When the drain valve 22 is opened, water may be supplied to a pump 24 through the drain bellows 21. The water inflowed into the pump 24 is discharged to the outside of the washing machine through a drain pipe 25 when the pump 24 is operated.

The pump 24 may selectively control the function of pumping the water discharged through the drain bellows 21 to the drain pipe 25 and the function of pumping the water to a circulation pipe 26 described later, under the control of the controller 17.

The pump 24 may include an impeller (not shown) for pumping water, a pump housing 24*d* in which the impeller is accommodated, and a pump motor 24*e* for rotating the impeller. The pump 24 may include an inflow port 24*a* which is connected to the bellows 21 and supplies water into the pump housing 24*d*, a drain discharge port 24*b* which is connected to the drain pipe 25, and discharges water, which is pumped by the impeller in the pump housing 24*d*, into the drain pipe 25, and a circulation water discharge port 24*c* which discharges water, which is pumped by the impeller in the pump housing 24*d*, into the circulation pipe 26.

The pump motor 24*e* may be capable of accomplishing a forward/reverse rotation. Depending on the direction in which the impeller rotates, water may be discharged through the drain discharge port 24*b* or water may be discharged through the circulation water discharge port 24*c*. Such a configuration can be implemented by appropriately designing the structure of the pump housing 24*d*. Since such a technology is already known in Korean Laid-Open Patent Publication No. 10-2013-0109354 and the like, a detailed description thereof will be omitted.

However, the present invention is not limited thereto, and a flow path switching valve (not shown) for selectively opening and closing the drain discharge port 24*b* and the circulation water discharge port 24*c* may be provided, under the control of the controller 17.

The inlet of the circulation pipe 26 is connected to the circulation water discharge port 24*c*, and the outlet is connected to a circulation water spray mechanisms 100*a*, 100*b*, 100*c* described later. However, it is not limited thereto, and a circulation pump for pumping water discharged from the outer tub 4 into the circulation pipe 26 and a drain pump for pumping water discharged from the outer tub 4 into the drain pipe 25 may be separately provided.

Preferably, the pump 24 (or the circulation pump) may be a pump capable of varying a speed (i.e., a variable speed pump). The pump 24 may include a variable speed pump motor 24*e* whose rotation speed is controlled. The pump motor 24*e* is preferably a brushless direct current motor, but is not necessarily limited thereto. A driver for speed control of the pump motor 24*e* may be further provided, and the driver may be an inverter driver. The inverter driver converts AC power into DC power to input to the motor at a target frequency, thereby controlling the pump motor 24*e* to rotate at a speed corresponding to the target frequency.

The controller 17 may include a Proportional-Integral Controller (PI controller), a Proportional-Integral-Derivative Controller (PID controller), and the like. The controller receives an output value (e.g., an output current) of the pump motor 24*e* as an input, and based on this, may control the driver so that the number of rotation (or rotation speed) of the pump motor 24*e* may follow a preset target number of rotation (or, target rotation speed).

Meanwhile, the controller 17 can control not only the pump motor 24*e* but also the overall operation of the washing machine, and it will be understood that the control of respective components mentioned below is performed by the control of the controller 17.

A pulsator 9 may be rotatably provided in the inner lower portion of the inner tub 6. The pulsator 9 may include a plurality of radial ribs protruding upwards. When the pulsator 9 is rotated, water flow may be formed by the ribs.

A drive unit 8 for providing power for rotating the inner tub 6 and the pulsator 9 may be disposed in the cabinet 2. The drive unit 8 may be disposed below the outer tub 4 and may be provided in the form of hanging in the cabinet 2 together with the outer tub 4. The rotation shaft of the drive unit 8 is always coupled to the pulsator 9, and may be coupled to or released from the inner tub 6 according to a switching operation of a clutch (not shown).

Therefore, when the drive unit 8 is operated while the rotation shaft of the drive unit 8 is coupled with the inner tub 6, the pulsator 9 and the inner tub 6 are integrally rotated. When the drive unit 8 is operated while the rotation shaft of the drive unit 8 is separated from the inner tub 6, only the pulsator 9 is rotated in the state where the inner tub 6 is stopped.

The drive unit 8 may include a washing motor capable of controlling a speed. The washing motor is preferably a brushless direct current motor (BLDC), but is not necessarily limited thereto.

The washing machine may include at least one water supply pipe 11 for guiding water supplied from an external water source such as a faucet. The at least one water supply pipe 11 may include a cold water pipe (not shown) receiving cold water from the external water source, and a hot water pipe (not shown) receiving hot water.

A water supply unit 13 for controlling the at least one water supply pipe 11 to be selectively opened and closed may be provided. The water supply unit 13 may include at least one water supply valve. When the at least one water supply valve is opened under the control of the controller 17, water is supplied to the dispenser 16 through the water supply pipe corresponding to the opened water supply valve.

The dispenser 16 supplies additives acting on the laundry together with the water into the inner tub 6. Additives supplied by the dispenser 16 include detergent for laundry and fabric softener for rinsing. The dispenser 16 may include a drawer 16*a* in which additive is accommodated, and a drawer housing 16*b* in which the drawer 16*a* is retractably received. A detergent accommodation unit (not shown) in which detergent for laundry is accommodated, and a softener accommodation unit (not shown) in which the fabric softener is accommodated may be partitioned in the drawer 16*a*.

When water is supplied to the detergent accommodation unit by the water supply unit 13, the supplied water is supplied to the inner tub 6 together with the detergent, and when the water is supplied to the fabric softener accommodation unit, the supplied water is supplied to the inner tub 6 together with the fabric softener. After water is supplied into the detergent accommodation unit or the fabric softener accommodation unit by the water supply unit 13, the detergent or the fabric softener does not exist any longer in the accommodation unit which achieved the water supply. Therefore, when water is supplied again later, the raw water supplied through the water supply unit 13 is supplied into the outer tub 4 intactly via the dispenser 16.

Referring to FIGS. 1 to 8, the washing machine according to an embodiment of the present invention includes a spray mechanism 100*a* for spraying water guided through the circulation pipe 26 into the inner tub 6. The spray mechanism 100*a* may be fixed to the outer tub cover 30.

The spray mechanism 100*a* may include a guide pipe 110*a* which is connected to the circulation pipe 26 and forms a guide flow path FP that guides water supplied from the circulation pipe 26 along the opening 30*h* formed in the outer tub cover 30, and a plurality of nozzles 120(1), 120(2), 120(3), 120(4), 120(5) which are disposed along the guide flow path FP and spray the water supplied from the guide pipe 110*a* into the inner tub 6

The circulation pipe 26 may be made of a flexible or deformable material. For example, the material may be rubber or synthetic resin, but is not limited thereto.

The guide pipe 110*a* may be formed in the form of a circular arc which is extended from a first end 111 (see FIG. 6) to a second end 112 (see FIG. 5) along the circumference of the opening 30*h* formed in the outer tub cover 30. The first end 111 is an open end and forms a port (hereinafter, also referred to as a "guide pipe port") connected to a connection pipe 130, and the second end 112 is closed. The guide pipe 110*a* (the same as the guide pipe of 110*b*, 110*c* described later) may be made of a synthetic resin material.

The connection pipe 130 may be made of a flexible or deformable material and, for example, the material is preferably rubber or synthetic resin, but is not limited thereto.

Referring to FIGS. 5 and 6, when the guide pipe 110*a* is viewed from the front, the guide flow path FP is extended in a ring or arc shape. As shown in FIG. 6, the radial width of the guide flow path FL is defined by two curved portions 113, 114 having concentricity. Hereinafter, one which is positioned inside among the two curved portions 113 and 114 is referred to as an inner diameter portion 113, and one which is positioned outside among the two curved portions 113 and 114 is referred to as an outer diameter portion 114.

Each of the nozzles 120(1), 120(2), 120(3), 120(4), and 120(5) may be configured in the form of protruding from the inner diameter portion 113 of the guide pipe 110*a*. The plurality of nozzles 120(1), 120(2), 120(3), 120(4), and 120(5) are preferably disposed at equal intervals, but are not necessarily limited thereto.

In the inner diameter portion 113 of the guide pipe 110*a*, nozzle communication holes 116 which communicate the guide flow path FP to an inlet 122 of each of the nozzles 120(1), 120(2), 120(3), 120(4), and 120(5) may be formed. The inlet 122 of the nozzle may be positioned in the inner diameter portion 113 of the guide pipe 110*a*. The nozzle 120(1), 120(2), 120(3), 120(4), 120(5) may include a collision surface 124 extended from the inner diameter portion 113, a first side surface 125, and a second side surface 126. In each of the nozzle 120(1), 120(2), 120(3), 120(4), and 120(5), an area recessed from an outlet 123(1), 123(2), 123(3), 123(4), 123(5) is formed by the inner circumferential surface (the surface on the inner diameter portion 113) of the guide pipe 110*a*, the collision surface 124, the first side surface 125, and the second side surface 126.

The collision surface 124 defines an angle formed by the water sprayed from the nozzle 120(1), 120(2), 120(3), 120(4), 120(5) with respect to horizon, and is inclined so that the water discharged from the inlet 122 of the nozzle 120(1), 120(2), 120(3), 120(4), 120(5) is bent downwardly. The first side 125 and the second side 126 define the width of the water sprayed from the nozzle 120(1), 120(2), 120(3), 120(4), 120(5) respectively, and define one side and the other side of the width respectively. For reference, FIG. 6 shows only the nozzle 120(1), but other nozzles 120(2), 120(3), 120(4), and 120(5) may also be substantially identically configured.

Referring to FIGS. 4 and 7, the outer tub cover 30 may include a cover ring 31 of a ring shape having an outer diameter portion coupled with the outer tub 4, and a rim 34 which is extended in the form of a circular arc along an inner diameter portion of the cover ring 31 and defines at least a portion of the opening 30*h*. In addition, the outer tub cover 30 may further include a support rib 35 having a circular arc shape that protrudes horizontally from the inner circumferential surface of the rim 34 facing the opening 30*h* and is extended along the circumferential direction.

The rim 34 may include an upper rim 34*a* protruding upward from the cover ring 31, and a lower rim 34*b* protruding downward from the cover ring 31, and the support rib 35 may protrude from the lower rim 34*b*.

The guide pipe 110*a* may be seated on the support rib 35. At this time, the outer diameter portion 114 of the guide pipe 110*a* is in contact with the rim 34. Since the guide pipe 110*a* is fitted in an area defined by the rim 34, it can be maintained in place without shaking even during operation of the washing machine.

The guide pipe 110*a* may be coupled to at least one of the rim 34 and the support rib 35 by welding. However, it is not limited thereto, and coupling using a fastening means such as a screw or a bolt is possible, and alternatively, bonding using an adhesive is also possible.

Referring to FIGS. 4 and 8, the outer tub cover 30 may further include a circulation pipe connection port 33 protruding from the outer surface of the cover ring 31. The circulation pipe 26 may be connected to the inlet of the circulation pipe connection port 33, and the connection pipe 130 may be connected to the outlet of the circulation pipe connection port 33.

The outlet of the circulation pipe connection port 33 may be positioned in the inner surface of the cover ring 31, and the connection pipe 130 may be inserted into the outlet of the circulation pipe connection port 33. A fastening member (not shown) for fixing the connection pipe 130 to the inner surface of the cover ring 31 may be provided so that the connection pipe 130 is not separated from the circulation pipe connection port 33.

The circulation pipe connection port 33 may be inserted into the circulation pipe 26, and a clamp (not shown) for tightening the outer circumferential surface of the circulation pipe 26 (particularly, the portion where the circulation pipe connection port 33 and the circulation pipe 26 are overlapped) may be further provided so that the circulation pipe 26 is not separated from the circulation pipe connection port 33.

Referring to FIG. 4, the outer tub cover 30 may further include a grill 32 formed in the inner side surrounded by the cover ring 31. The grill 32 is positioned below the dispenser 16, and furthermore is positioned between the first end 111 and the second end 112 of the guide pipe 110*a* when the washing machine is viewed from the front. The water discharged from the dispenser 16 passes through the grill 32 and is supplied to the inner tub 6.

Figure 9:
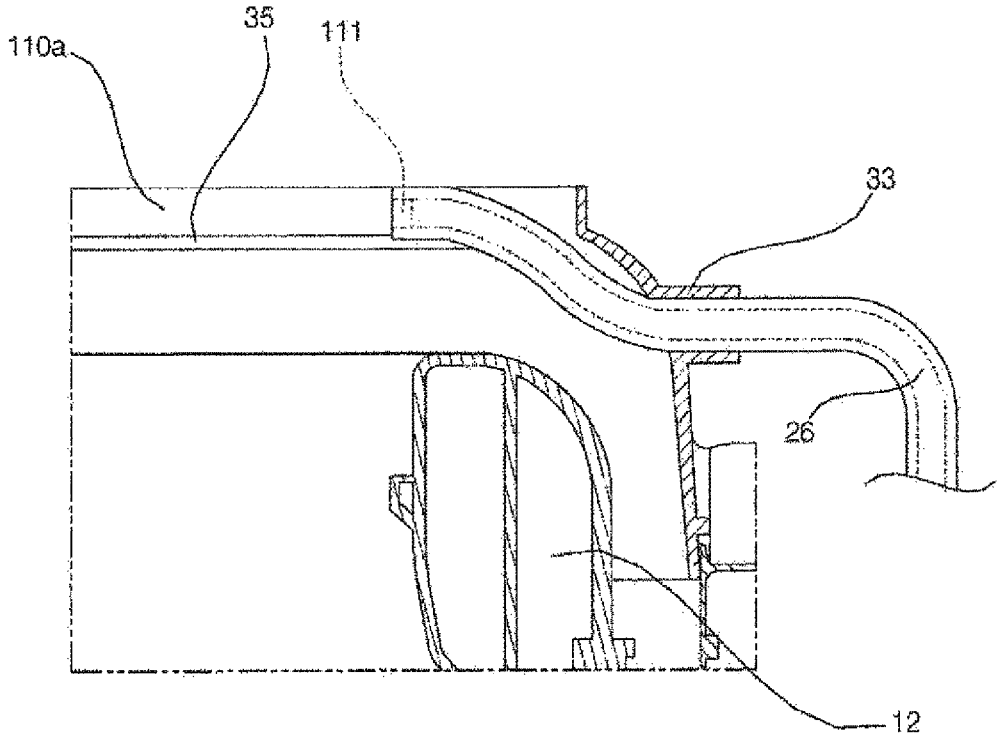
FIG. 9 shows another embodiment of a structure in which a spray mechanism and a circulation pipe are connected.

FIG. 9 shows another embodiment of a structure in which a spray mechanism and a circulation pipe are connected. Referring to FIG. 9, the circulation pipe 26 may be connected to a second port (or guide pipe port 111) formed in the guide pipe 110*a* through a first port 33 (in the above embodiment, a configuration referred to as the "circulation pipe connection port", but in the present embodiment, referred to as a "first port") formed in the outer tub cover 30. Since the connection pipe 130 (see FIG. 8) is not necessary, the flow path is simplified. In particular, it is enough that only the circulation pipe 26 fitted into the second port 111 is fixed by using a clamp (not shown), there is an effect that the number of necessary clamps can be reduced and the number of assembly processes in the manufacturing process can be reduced.

Figure 10:
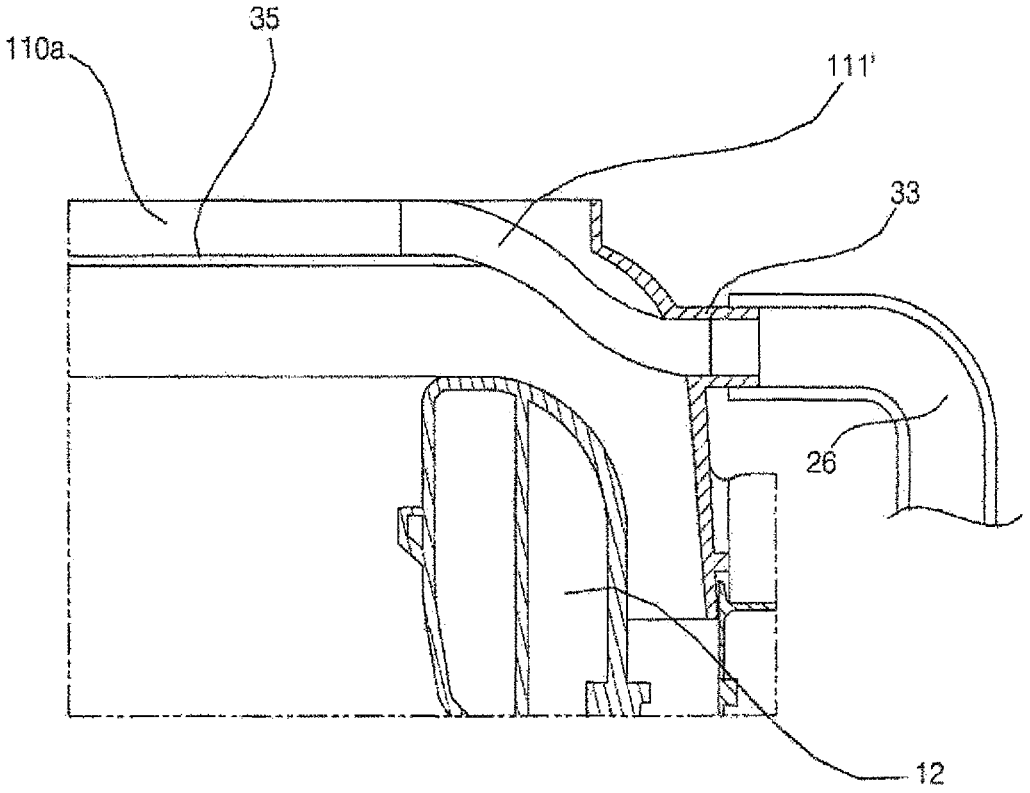
FIG. 10 shows another embodiment of a structure in which a spray mechanism and a circulation pipe are connected.

FIG. 10 shows another embodiment of a structure in which a spray mechanism and a circulation pipe are connected. Referring to FIG. 10, the flow path connection between the circulation pipe 26 and the guide pipe 110*a* may be achieved by inserting the guide pipe port 111' protruding from the guide pipe 1100 into the circulation pipe connection port 33. The guide pipe 110*a* and the circulation pipe 26 may be flow-path connected in a simple manner that the guide pipe port 111' is inserted into the outlet of the circulation pipe connection port 33 and the circulation pipe 26 is inserted into the inlet of the circulation pipe connection port 33.

Figure 11:
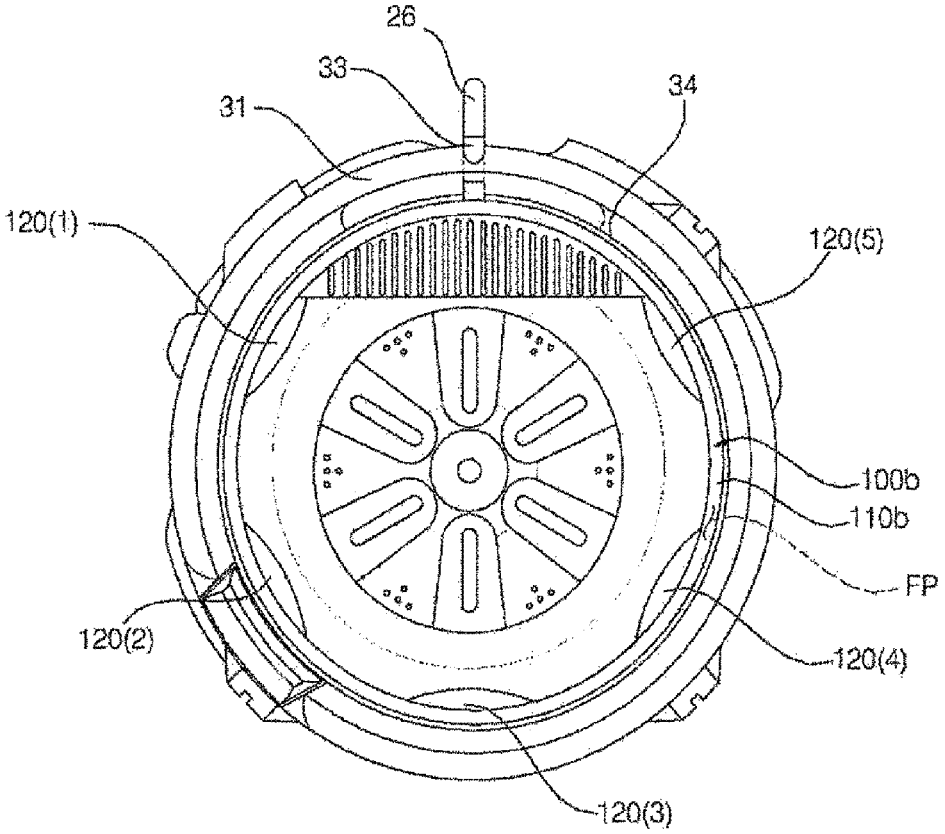
FIG. 11 is a partial view of a washing machine according to another embodiment of the present invention.
Figure 12:
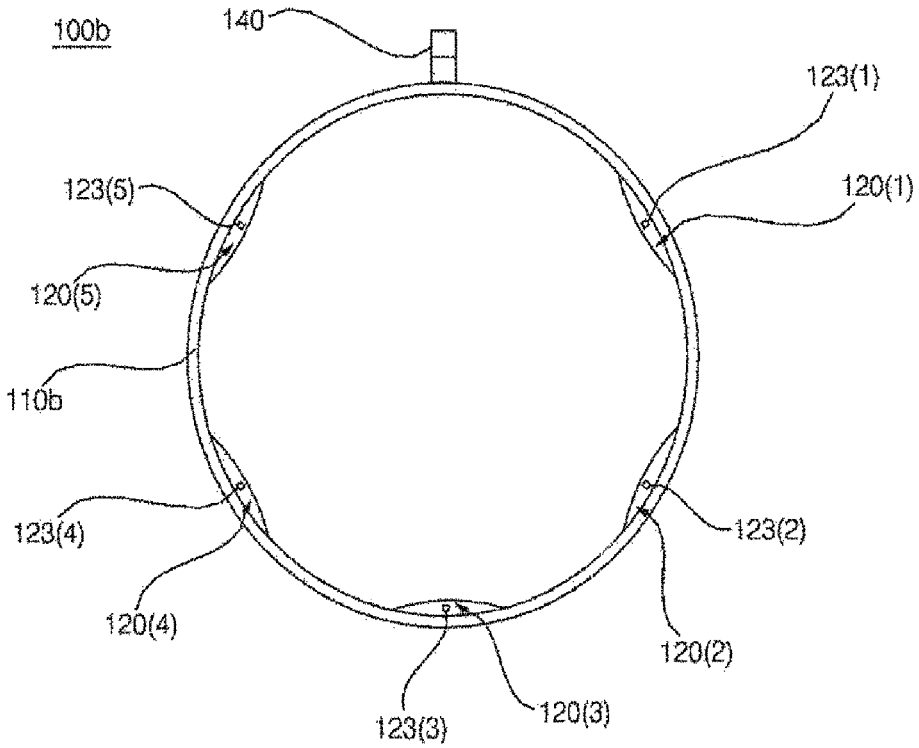
FIG. 12 shows a spray mechanism shown in FIG. 11.

FIG. 11 is a partial view of a washing machine according to another embodiment of the present invention. FIG. 12 shows a spray mechanism shown in FIG. 11. Referring to FIGS. 11 to 12, the spray mechanism 100*b* may include an annular (or circular) guide pipe 110*b*. An annular guide flow path FP is formed by the annular guide pipe 110*b*, and a plurality of nozzles 120(1), 120(2), 120(3), 120(4), and 120(5) are disposed along the guide flow path FP.

The guide pipe port 140 may be extended from the outer circumferential surface of the guide pipe 110*b*. One end of the guide pipe port 140 is in communication with the guide flow path FP, and the other end is flow-path connected to the circulation pipe 26. The flow path connection between the guide pipe port 140 and the circulation pipe 26 according to any of the above-described embodiments with reference to FIGS. 8 to 10 will do. The water pumped by the pump 24 flows along the circulation pipe 26 and flows into the guide pipe port 140, and, in this process, may pass through the connection pipe 130 (see FIG. 8) depending on the embodiment.

The water passed through the guide pipe port 140 is branched to both sides to fill a circular (or annular) guide flow path FP. Since the circular guide flow path FP has no place where the flow is stagnant, no residual water remains in the flow path and most of the water is discharged through the nozzles 120(1), 120(2), 120(3), 120(4), and 120(5). Therefore, as much, the contamination due to the blockage of the guide flow path FP, the water scale, or the detergent residues is prevented.

Meanwhile, in the embodiment described above, the manner in which the guide pipe 110*b* is installed in the outer tub cover 30 can be achieved in substantially the same manner as in the embodiment described above with reference to FIG. 7.

Figure 13:
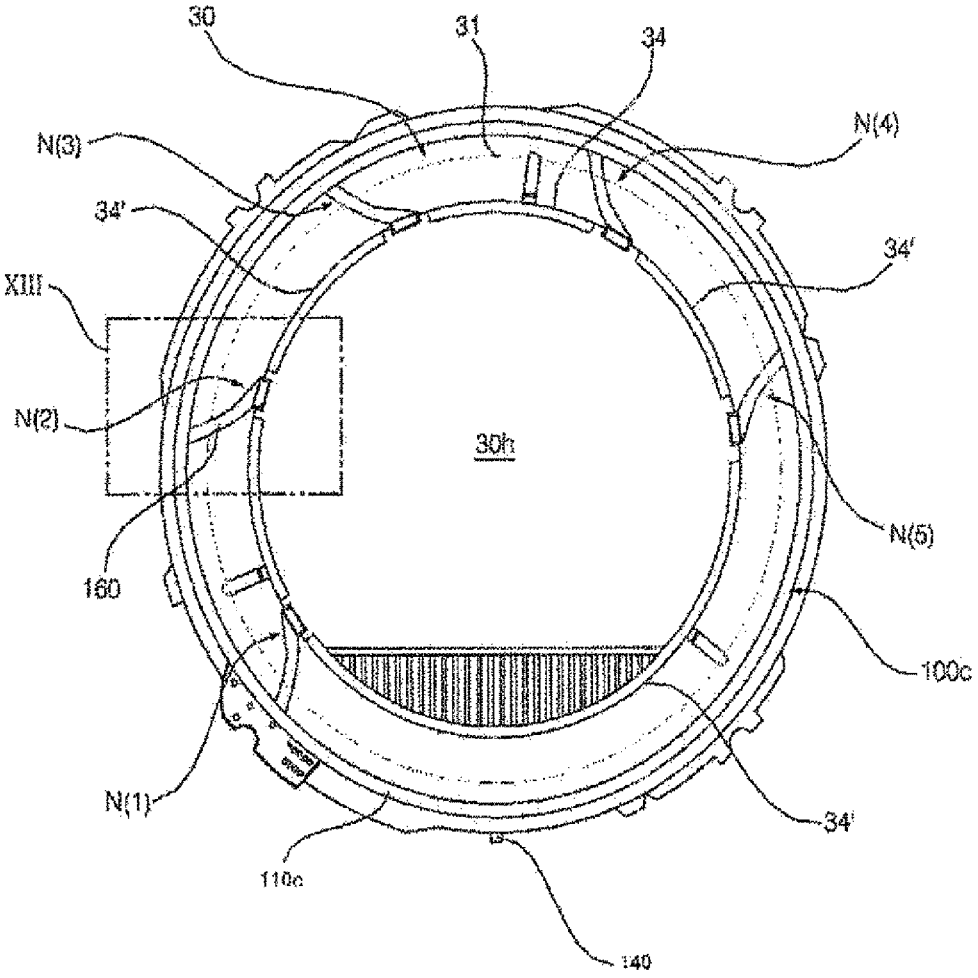
FIG. 13 is a partial view of a washing machine according to another embodiment of the present invention.
Figure 14:
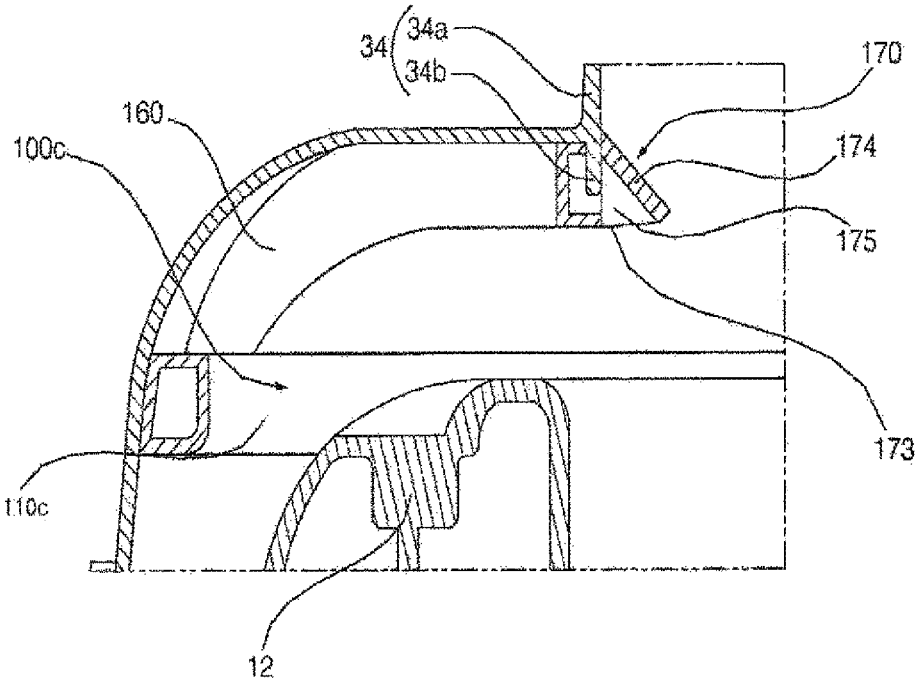
FIG. 14 shows a cross section taken from a portion XIII of FIG. 13.
Figure 15:
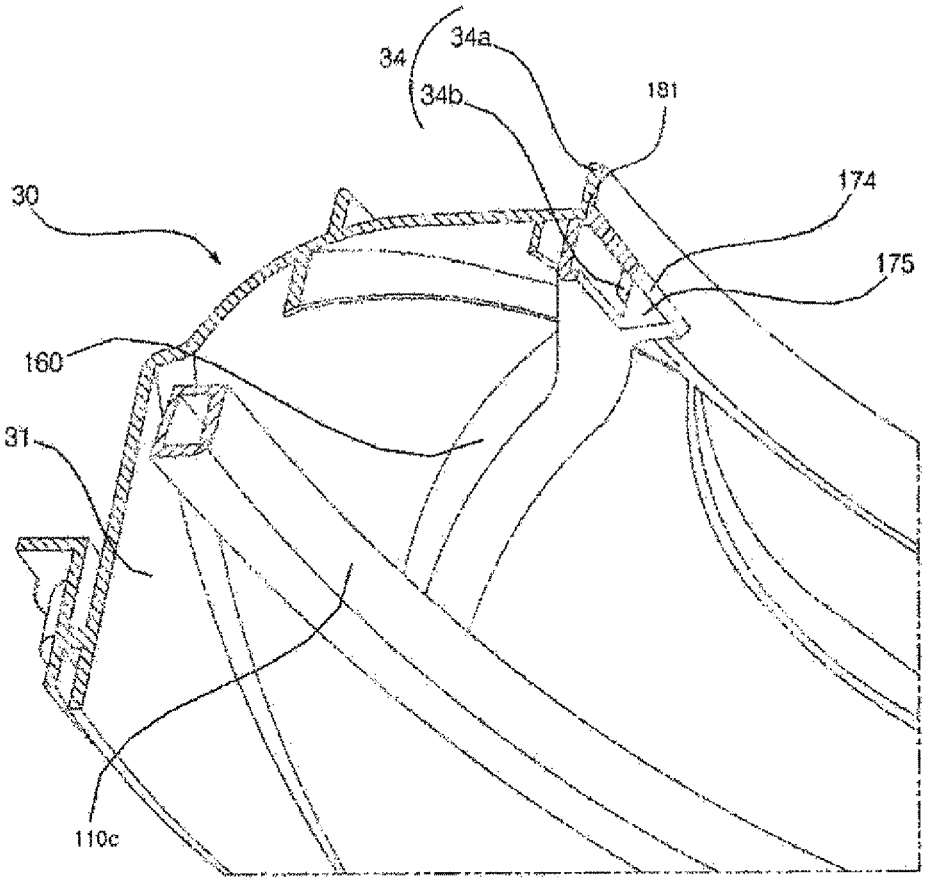
FIG. 15 is a perspective view of FIG. 14.
Figure 16:
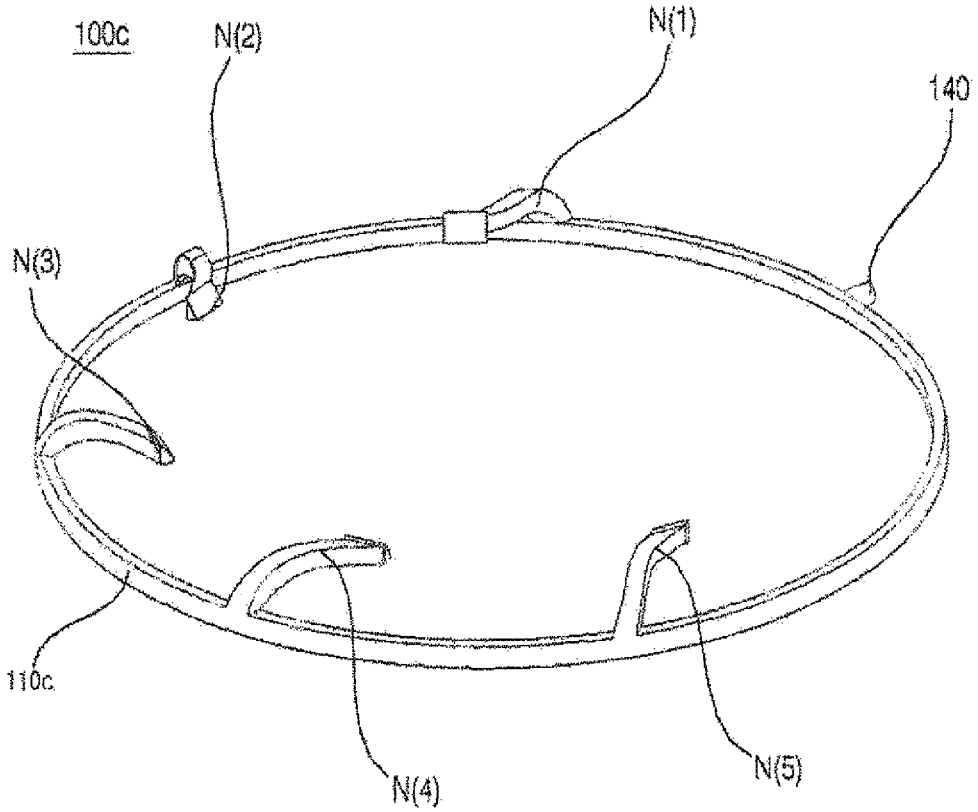
FIG. 16 shows a spray mechanism shown in FIG. 13.
Figure 17:
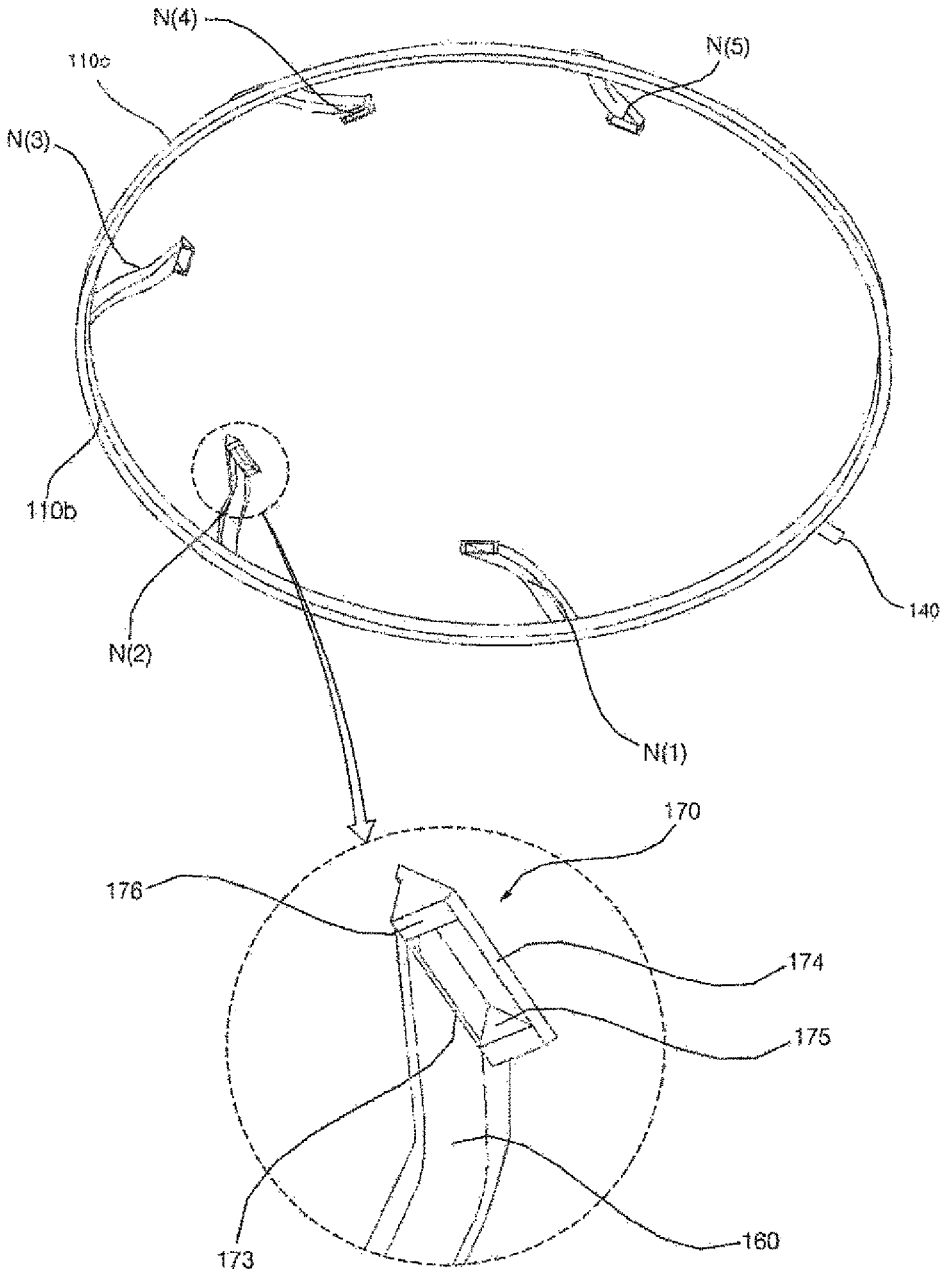
FIG. 17 shows the spray mechanism shown in FIG. 16 viewed from below.

FIG. 13 is a partial view of a washing machine according to another embodiment of the present invention. FIG. 14 shows a cross section taken from a portion XIII of FIG. 13. FIG. 15 is a perspective view of FIG. 14. FIG. 16 shows a spray mechanism shown in FIG. 13. FIG. 17 shows the spray mechanism shown in FIG. 16 viewed from below.

Referring to FIGS. 13 to 17, the spray mechanism 100*c* includes a guide pipe 110*c* and a plurality of nozzle modules N(1), N(2), N(3), N(4), and N(5) extended from the guide pipe 110*c*.

Each nozzle module N(1), N(2), N(3), N(4), N(5) includes a nozzle connection pipe 160 extended along the bottom surface of the cover ring 31 toward the opening 30*h*, and a nozzle 170 which is connected to the nozzle connection pipe 160 and sprays water supplied from the nozzle connection pipe 160.

The nozzle connection pipe 160 may be extended diagonally from the guide pipe 110 at a certain angle with respect to a radial direction. When the inner tub 6 is rotated at an appropriate speed in consideration of the water level in the outer tub 4, the water in the outer tub 4 is raised along between the inner tub 6 and the outer tub 4 by centrifugal force, and is guided in the centrifugal direction along the bottom surface of the cover ring 31 and poured into the inner tub 6. At this time, the travel direction of the water flow flowing along the bottom surface of the cover ring 31 has a circumferential component. Since such a water flow is guided by the nozzle connection pipe 160 diagonally disposed in the bottom surface of the cover ring 31, the water flow in the bottom surface of the cover ring 31 can be further enhanced.

The nozzle 170 may include a collision surface 174 on which water supplied through the nozzle connection pipe 160 collides, a first side surface 175, and a second side surface 176. The collision surface 174 defines an angle formed by the water sprayed from the nozzle 170 with respect to horizon, and is inclined such that water is discharged downward from the outlet 173 of the nozzle 170.

The first side surface 175 and the second side surface 176 define the width of the water sprayed from the nozzle 170 respectively, and define one side and the other side of the width respectively.

A portion where each nozzle 170 and the nozzle connection pipe 160 are connected may form a step. At least a part of the nozzle 170 protrudes upward from the nozzle connection pipe 160, and a portion where such a protruded portion and the upper surface of the nozzle connection pipe 160 are connected may form a "L" shaped step 181 (see FIG. 15).

The outer tub cover 30 may include an upper rim 34*a* protruded upward from the inner diameter portion of the cover ring 31 and extended in the circumferential direction to define at least a portion of the opening 30*h*, and a plurality of lower rims 34*b* protruded downward from the inner diameter portion of the cover ring 31 from a portion corresponding to the upper rim 34*a* and extended along the circumferential direction.

In particular, each of the lower rims 34*b* is formed in the form of a circular arc, and adjacent ones may be spaced at certain intervals. The upper surface of the nozzle connection pipe 160 is positioned in the spaced portion (i.e., the bottom surface of the cover ring 31 in which the lower rims 34*b* is not formed), and the inner circumferential surface of the upper rim 34*a* corresponding to the spaced portion comes into contact with the nozzle 170. Meanwhile, the nozzle connection pipe 160 may be provided with a rim insertion hole (not shown, a hole through which the lower rim 34*b* is inserted into the nozzle connection pipe 160 in FIG. 14) through which the lower rim 34*b* passes. By rotating the spray mechanism 100*c*, one end of the lower rim 34*b* may be inserted into the rim insertion hole. The rim insertion hole may be formed in each nozzle 170. When the spray mechanism 100*c* is rotated, each lower rim 34*b* may be inserted into the rim insertion hole formed in the adjacent nozzle 170 simultaneously.

The guide pipe 110*c* may be coupled to the outer tub cover 30 by welding. However, it is not limited thereto, and coupling by using fastening means such as a screw or a bolt is also possible, and alternatively, bonding by using an adhesive is also possible.

Figure 18:
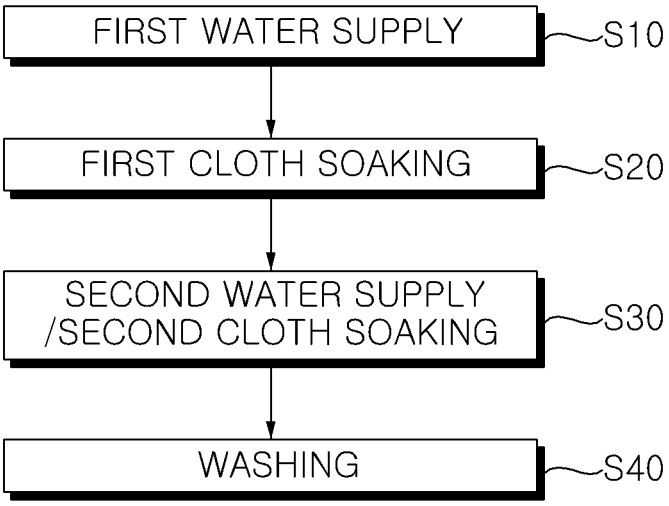
FIG. 18 is a flowchart illustrating a control method of a washing machine according to an embodiment of the present invention.
Figure 19:
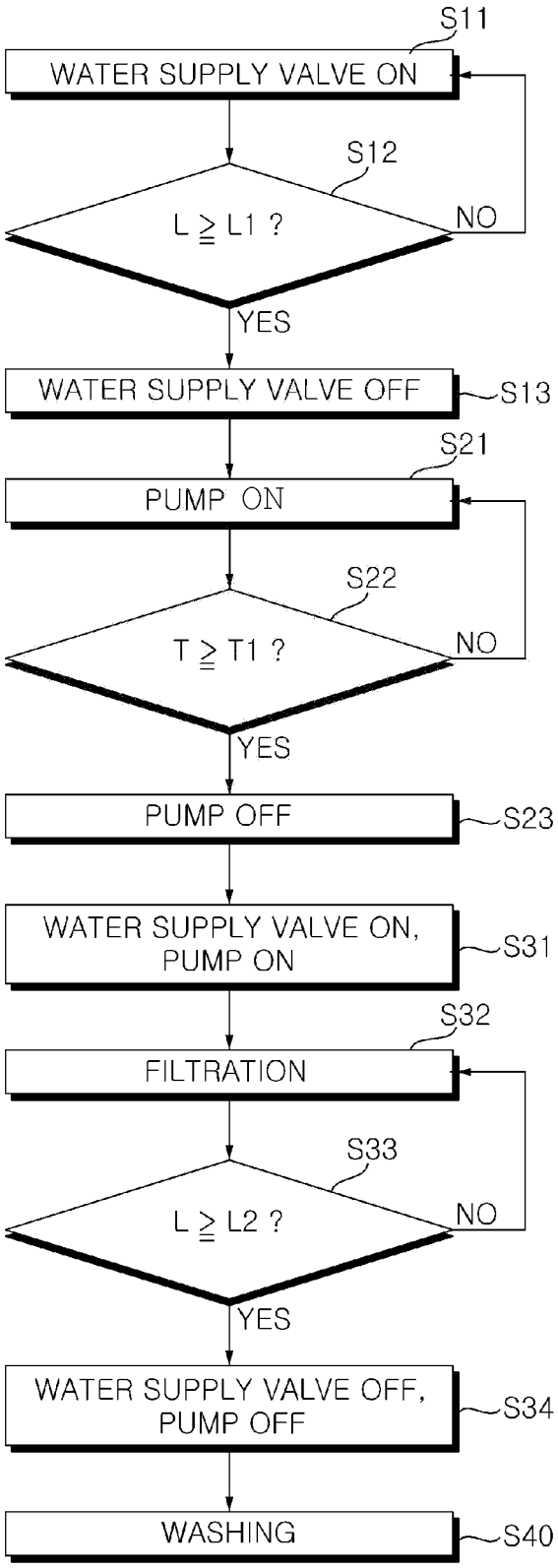
FIG. 19 is a flowchart illustrating respective steps shown in FIG. 18 in more detail.
Figure 20:
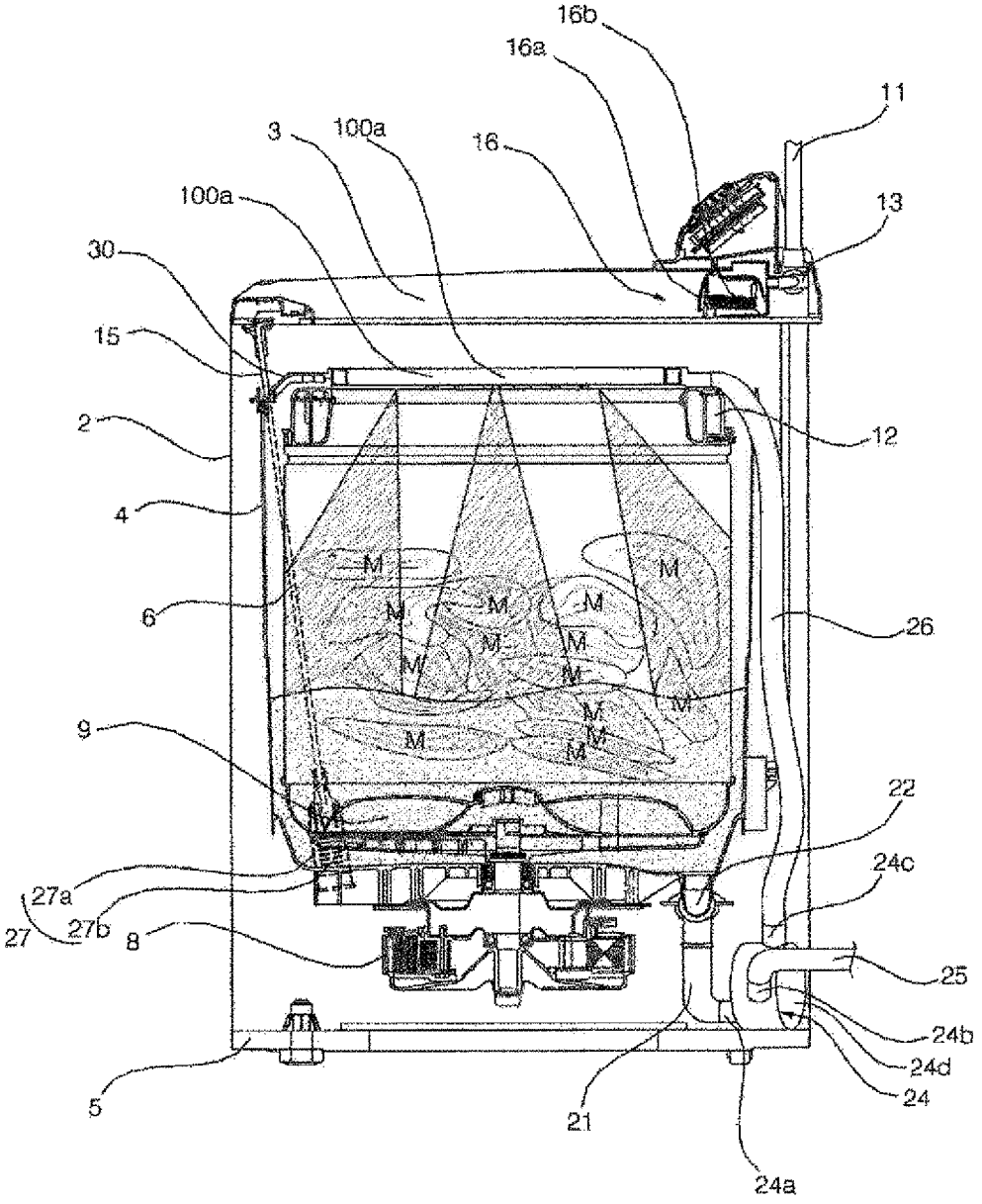
FIG. 20 shows a washing machine in which a first cloth soaking step is performed.
Figure 21:
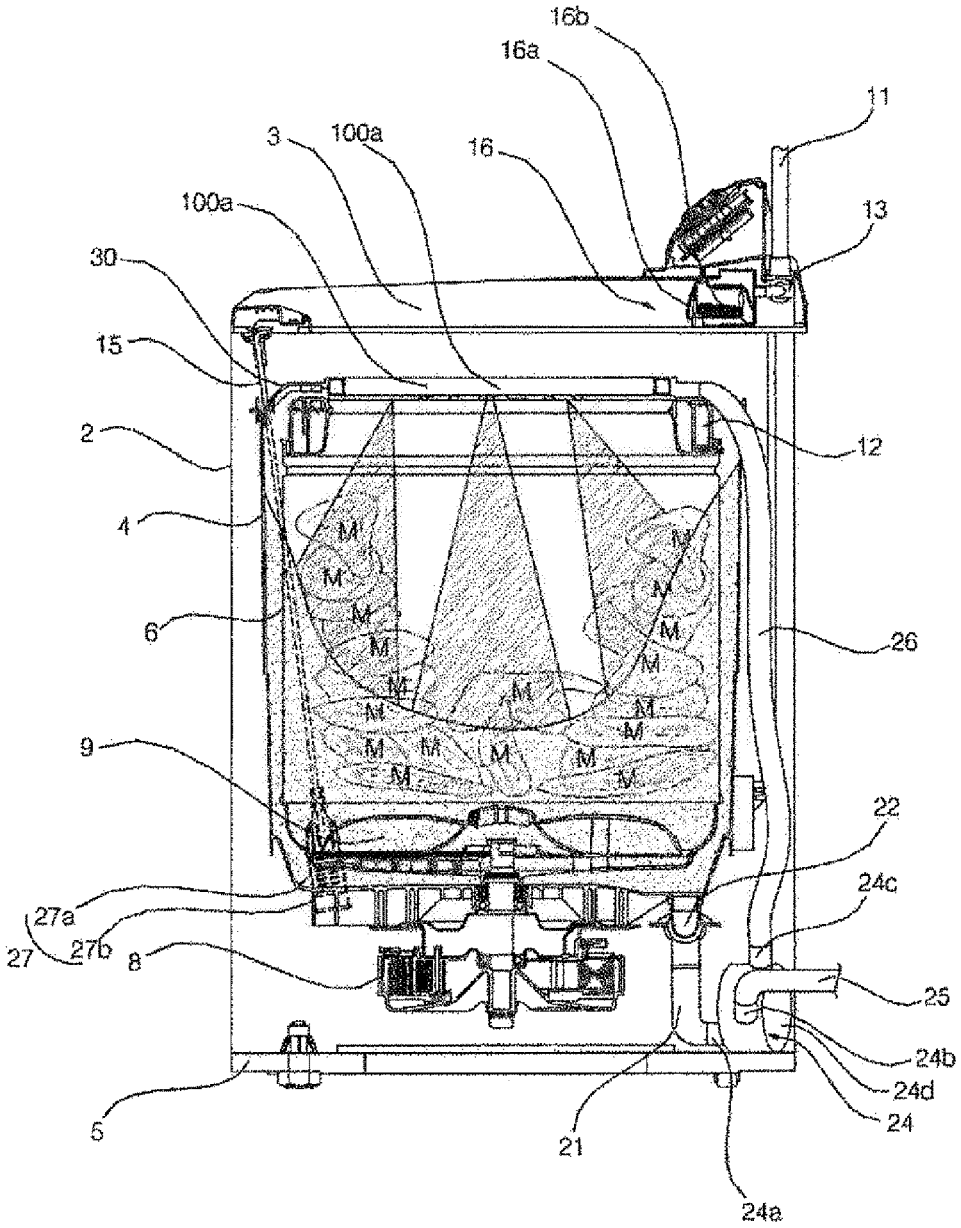
FIG. 21 shows a washing machine in which a second cloth soaking step is performed.

FIG. 18 is a flowchart illustrating a control method of a washing machine according to an embodiment of the present invention. FIG. 19 is a flowchart illustrating respective steps shown in FIG. 18 in more detail. FIG. 20 shows a washing machine in which a first cloth soaking step is performed. FIG. 21 shows a washing machine in which a second cloth soaking step is performed.

The control method according to an embodiment described below with reference to FIGS. 18 to 21 may be applied to any of the washing machines according to the above-described embodiments.

Referring to FIGS. 18 to 21, the control method of the washing machine according to an embodiment of the present invention includes a water supply step (S10), a first cloth soaking step (S20), and a second cloth soaking step (S30).

In a typical washing machine, the washing cycle includes a water supply process, a washing process, a rinsing process, and a dehydration process. In the water supply process, water is supplied into the inner tub 6 (or the outer tub 4) up to a preset water level (or water amount). In the water supply process, detergent also may be supplied during the water supply.

The washing process is a process of removing the contamination of the cloth by using water and detergent supplied from the water supply process, and the rotation of at least one of the inner tub 6 and the pulsator 9 is controlled according to a preset algorithm. The washing process is finished with the drainage and the rinsing process is performed after the drainage.

The rinsing process is a process of removing the detergent remaining in the cloth by supplying the water containing no detergent or the water containing fabric softener into the inner tub 6. The rotation of the inner tub 6 and/or the pulsator 9 is controlled according to a preset algorithm. The rinsing process is finished with the drainage, and the dehydration process is performed after the drainage.

In the dehydration process, the inner tub 6 is rotated according to a preset algorithm, so that the cloth is dehydrated and the water discharged from the cloth is drained. The washing cycle is also terminated with the termination of the dehydration process. However, in the case of a washing machine having a drying function, a drying process for drying the cloth by applying hot or cold air into the inner tub 6 may be added.

The water supply step (S10), the first cloth soaking step (S20), and the second cloth soaking step (S30) are preferably performed during the water supply process, but is not necessarily limited thereto.

The water supply step S10 is a step of supplying the detergent contained in the dispenser 16 together with water into the inner tub 6. Under the control of the controller 17, among at least one water supply valve provided in the water supply unit 13, a configuration of supplying water to a detergent accommodation unit is opened (S11), and the supplied water is supplied into the inner tub 6 together with the detergent contained in the detergent accommodation unit.

During water supply through the dispenser 16, the water level is detected by a water level sensor 19. Referring to FIG. 2, the washing machine may include a communication pipe 18 communicating with the outer tub 4. The water level rises in the outer tub 4 due to the water supply, and thus the water level in the communication pipe 18 also rises, thereby raising the pneumatic pressure (air pressure) in the communication pipe 18. The water level sensor 19 may output the water level frequency according to the change of pneumatic pressure in the communication pipe 18. However, the present invention is not limited thereto, and the water level sensor 18 may be configured in various known methods.

The controller 17 compares the water level L of the outer tub 4 detected by the water level sensor 18 with a preset first water level L1 (S12), and based on the comparison result, when it is determined that the water level L reaches the first water level L1, the water supply valve may be blocked (S13).

Thereafter, the first cloth soaking step (S20) of soaking cloth by operating the pump 24 so that the water in the outer tub 4 (i.e., the water supplied with the detergent) is transferred to a plurality of nozzles (120(1) to 120(5) or 170, according to embodiments) disposed above the inner tub 6.

In the first cloth soaking step (S20), the pump 24 is operated at a first speed so that water is sprayed through the nozzles provided in the spray mechanisms 100*a*, 100*b*, and 100*c* (S21). If the speed of the pump 24 is too fast, the pump 24 may be temporarily idle, before the water sprayed from the spray mechanisms 100*a*, 100*b*, 100*c* passes through the laundry and flows into the pump 24 again. In particular, since the first cloth soaking step (S20) is achieved in a state where the water level in the outer tub 4 is relatively lower in the second cloth soaking step (S30) described later, the flow rate circulated by the pump 24 is also relatively small. Therefore, in the first cloth soaking step (S20), it is preferable that the speed of the pump 24 may be set within a range where idling is not performed so as to prevent generation of noise due to idling or lack of water in the pump housing 24*d*.

In the first cloth soaking step (S20), the detergent water sprayed through the nozzles is directly applied to the loaded laundry of the inner tub 6. In particular, since the water supplied through the guide pipe (110*a*, 110*b*, 110*c*) is sprayed simultaneously from the nozzles, detergent water is quickly applied to a wide range. In addition, since dissolution of the detergent is promoted by the stirring action of the impeller of the pump 24, the detergent water in which the detergent is evenly dissolved can be applied to the laundry.

The first cloth soaking step (S20) may be performed for a preset time T1. That is, the controller 17 determines whether a preset time T1 has elapsed from the time point when the operation of the pump 24 starts (S22), and the operation of the pump 24 may be terminated when the operation time T of the pump 23 reaches the preset time T1 (S23).

Thereafter, the second cloth soaking step (S30) may be performed. In the second cloth soaking step (S30), water is additionally supplied into the outer tub 4 (secondary water supply), and the pump 24 is operated to spray water again through the spray mechanisms 100*a*, 100*b*, 100*c* (secondary cloth soaking).

In the second cloth soaking step (S30), the pump 24 may be operated again (S31), after the first cloth soaking step (S20) is terminated (S23) and a certain time is elapsed. That is, the pump 24 may be operated again after the pump 24 is stopped (S23) in the first cloth soaking step (S20) and a certain time is elapsed. However, the present invention is not necessarily limited thereto, and step S23 may be omitted and the operation of the pump 24 in the first cloth soaking step S20 may continue until the second cloth soaking step (S30).

In the second cloth soaking step (S30), the pump 24 is operated in the state where the water level is increased in comparison with the first cloth soaking step S10, so that the flow rate transferred by the pump 24 may be further increased. Therefore, in the second cloth soaking step (S30), the pump 24 may be operated at a second speed that is higher than the first speed (speed in the first cloth soaking step (S20)).

Meanwhile, in the embodiment, the water supply (S31) in the second cloth soaking step (S30) is to reopen (S31) the water supply valve that is closed after the completion of the water supply step S10, but other water supply valve may be opened. Alternatively, a separate direct water nozzle (not shown) configured to directly spray water supplied from an external water source into the inner tub 6 may be provided, and water may be supplied through the direct water nozzle. Since the detergent contained in the drawer 16*a* is exhausted in the water supply step S10, the detergent is no longer supplied even when water is supplied through the dispenser 16 in the second cloth soaking step (S30). That is, since the water supply in the second cloth soaking step (S30) is not intended to supply detergent, a water supply means does not need to be limited to the water supply valve used in the first cloth soaking step (S30).

In the second cloth soaking step (S30), the pump 24 may be operated (S31) while the water is supplied into the outer tub 4 (or the inner tub 6). Thus, while the pump 24 is operating, a filtration step may be performed (S32).

The filtration step S32 may include a step of rotating the inner tub 6 so that the laundry (or cloth) contained in the inner tub 6 adheres to the inner surface of the inner tub 6 by centrifugal force. In the filtration step S32, as shown in FIG. 21, the laundries Ms adhere to the inner surface of the inner tub 6 by centrifugal force acting by the rotation of the inner tub 6, and the water level between the inner tub 4 and the outer tub 6 is in an elevated state. After the detergent water in the inner tub 6 has passed through the laundry M, it is discharged to the outer tub 4 through the through holes formed in the inner surface of the inner tub 6, so that the detergent can infiltrate deeply into the laundry M.

Meanwhile, in the filtration step S32, the rotation speed of the inner tub 6 is appropriately controlled. Thus, it is also possible to form water stream flowing into the inner tub 6 again, after the water flow which is raised from between the outer tub 4 and the inner tub 6 reaches the outer tub cover 30, and is guided along the bottom surface of the covering ring 31.

While the second cloth soaking step (S30) is being performed, the controller 17 compares the water level L of the outer tub 4 detected by the water level sensor 19 with a preset second water level (L2, L2>L1) (S33). As a result of the comparison, if it is determined that the water level L reaches the second water level L2, the controller 17 may block the water supply valve (S34). At this time, the operation of the pump 24 may also be terminated (S34).

Meanwhile, according to the embodiment, the water level determination in step S33 may be achieved based on the value detected in the state where the rotation of the inner tub 6 is stopped. Since the centrifugal force caused by the rotation of the inner tub 6 becomes a factor of raising the water level, the value detected at this time does not reflect the exact water level in the outer tub 4. Therefore, when it is determined that the water level L detected by the water level sensor 19 reaches the second water level L2 in the state where the inner tub 6 is stopped, the controller 19 stops water supply (i.e., block the water supply valve), and then may perform filtration (S32). In addition, the operation of the pump 24 may also be stopped while water is being supplied in the state where the inner tub 6 is stopped. In this case, the pump 24 may be operated after the water level L reaches the second water level L2.

Meanwhile, the speed of the pump 24 may be varied in the second cloth soaking step (S30). The controller 17 operates the pump 24 at a relatively low speed in the beginning stage of the second cloth soaking step (S30). Then, if the water level in the outer tub 4 is gradually raised as the water is continuously supplied, the speed of the pump 24 can be increased.

After the second cloth soaking step (S30), the washing step S40 may be performed. The washing step S40 is a step of removing contamination by applying mechanical force to the laundry which sufficiently absorbed the detergent through a previous step, and the rotation of at least one of the inner tub 6 and the pulsator 9 may be controlled according to a preset algorithm.

The invention claimed is:

1. A method of controlling a washing machine, the method comprising the steps of:

(a) supplying detergent contained in a dispenser together with water into an inner tub that is configured to receive laundry until a water level in an outer tub in which the inner tub is rotatably accommodated reaches a preset first water level;

(b) operating a pump for a preset time period at a first rotating speed to transfer the water supplied together with the detergent to a plurality of nozzles disposed above the inner tub in a state where the inner tub is stopped, wherein the first rotating speed is within an operating range of the pump; and (c) stopping the pump after the preset time period has elapsed, further supplying water into the inner tub until the water level in the outer tub reaches a preset second water level in the state where the inner tub is stopped, and then operating the pump at a second rotating speed and rotating the inner tub so that laundry contained in the inner tub adheres to an inner surface of the inner tub by centrifugal force during the operation of the pump, wherein the preset second water level is higher than the first preset water level, and the second rotating speed is higher than the first rotating speed.

2. The method of claim 1, wherein the step (a) comprises:

opening a water supply valve for supplying water to the dispenser; and blocking the water supply valve, based on the water level in the outer tub reaching the preset first water level.

3. The method of claim 2, wherein the step (c) comprises:

opening the water supply valve; and blocking the water supply valve, based on the water level in the outer tub reaching the preset second water level.

4. The method of claim 1, wherein, in the step (c), the second rotating speed is increased according to an increment of the water level in the outer tub.

5. The method of claim 1, wherein the first rotating speed is set within the operating range where idling of the pump is not performed.

6. The method of claim 1, wherein the operating range does not include an idling speed of the pump.

7. The method of claim 1, wherein the first rotating speed limits generation of noise due to idling.

8. The method of claim 1, wherein the first rotating speed limits generation of noise due to lack of water in a housing of the pump.

9. A method of controlling a washing machine, the method comprising the steps of:

(a) supplying detergent contained in a dispenser together with water into an inner tub that is configured to receive laundry until a water level in an outer tub in which the inner tub is rotatably accommodated reaches a preset first water level;

(b) operating a pump for a preset time period at a first rotating speed to transfer the water supplied together with the detergent to a plurality of nozzles disposed above the inner tub in a state where the inner tub is stopped, wherein the first rotating speed is within an operating range of the pump; and (c) stopping the pump after the preset time period has elapsed, further supplying water into the inner tub through the dispenser until the water level in the outer tub reaches a preset second water level in the state where the inner tub is stopped, and then operating the pump at a second rotating speed that is higher than the first rotating speed, wherein the step (c) further comprises rotating the inner tub so that laundry in the inner tub adheres to an inner surface of the inner tub by centrifugal force during the operation of the pump, and wherein the preset second water level in the outer tub is higher than the preset first water level.

10. The method of claim 9, wherein the step (a) comprises:

opening a water supply valve for supplying water to the dispenser; and blocking the water supply valve, based on the water level in the outer tub reaching the preset first water level.

11. The method of claim 9, wherein the step (c) further comprises stopping water supply based on the water level in the outer tub reaching the preset second water level.

12. The method of claim 9, further comprising washing laundry by controlling rotation of at least one of the inner tub and a pulsator rotatably provided in the inner tub, after the step (c).

13. The method of claim 9, wherein the first rotating speed is set within the operating range where idling of the pump is not performed.

14. The method of claim 9, wherein the operating range does not include an idling speed of the pump.

15. The method of claim 9, wherein the first rotating speed limits generation of noise due to idling.

16. The method of claim 9, wherein the first rotating speed limits generation of noise due to lack of water in a housing of the pump.

* * * * *